US008130100B2

(12) United States Patent
Barger

(10) Patent No.: US 8,130,100 B2
(45) Date of Patent: Mar. 6, 2012

(54) AIR CONDITIONER ANTI-THEFT

(76) Inventor: Mike Barger, Indianapolis, IN (US)

( * ) Notice: Subject to any disclaimer, the term of this patent is extended or adjusted under 35 U.S.C. 154(b) by 277 days.

(21) Appl. No.: 11/731,278

(22) Filed: Mar. 30, 2007

(65) Prior Publication Data

US 2008/0237435 A1 Oct. 2, 2008

(51) Int. Cl.
*G08B 13/14* (2006.01)

(52) U.S. Cl. ..... 340/568.1

(58) Field of Classification Search ..... 340/568.2, 340/506, 539.16, 571, 540, 568.1
See application file for complete search history.

(56) References Cited

U.S. PATENT DOCUMENTS

| | | | | |
|---|---|---|---|---|
| 4,584,571 | A | 4/1986 | Smit et al. | |
| 4,751,499 | A | 6/1988 | Chen | |
| 4,816,803 | A | 3/1989 | Brown | |
| 5,844,484 | A | 12/1998 | Fujiuchi et al. | |
| 6,400,267 | B1 * | 6/2002 | Gordon-Levitt et al. | 340/547 |
| 6,963,281 | B2 | 11/2005 | Buckley | |
| 6,975,220 | B1 * | 12/2005 | Foodman et al. | 340/531 |
| 7,019,634 | B2 * | 3/2006 | Bissett et al. | 340/506 |
| 7,187,284 | B2 * | 3/2007 | Masciantonio | 340/568.2 |
| 2003/0201892 | A1 * | 10/2003 | Chance et al. | 340/568.2 |

* cited by examiner

*Primary Examiner* — Phung Nguyen
(74) *Attorney, Agent, or Firm* — Bryan S. Redding

(57) ABSTRACT

The present invention discloses an easy to use and cost effective air conditioner anti-theft device which easily attaches to the external portion of an air conditioner and detects a condition of attempted theft and/or vandalism of the unit and then alerts someone to the condition either through audible or other means.

15 Claims, 1 Drawing Sheet

AIR CONDITIONER ANTI-THEFT

CROSS-REFERENCE TO RELATED APPLICATIONS

Not Applicable.

STATEMENT REGARDING FEDERAL SPONSORED RESEARCH OR DEVELOPMENT

Not Applicable.

REFERENCE TO SEQUENCE LISTING, ETC.

Not Applicable.

BACKGROUND

The present invention relates to an improved unit to protect an air conditioner, and more specifically the compressor portion of an air conditioner, from theft. Sometimes this compressor portion is part of a self-contained unit, such as a window model air conditioner, but more traditionally, the compressor portion is located outside the structure being cooled by the air conditioner. In a typical air conditioner unit, in the compressor portion, a fan blows air across condenser coils, heat exchange fins, and associated elements of the condenser coil unit. The purpose of these condenser coils, heat exchange fins, and associated elements, is to remove heat from a refrigerant coolant, as it passes through the coils, fins and associated elements. These condenser coils, fins and associated elements are typically constructed from a metal which is independently valuable, other than as a coil, fin or associated element. They are often made of copper, aluminum or both. These elements make this portion of an air conditioner the common target of theft and/or vandalism. There is currently no device available which addresses this issue, thus, there exists a significant demand for a device that provides an easy, effective and cost-efficient way to protect an air conditioner compressor from theft. The present invention relates generally to a device that is inexpensive, easy to incorporate and is effective at preventing theft and vandalism of this component of an air conditioner.

BRIEF SUMMARY

The present invention is directed to the needs and desires noted above for theft and/or vandalism prevention of the compressor portion of an air conditioner. It is a further object of this invention that the device be of relatively inexpensive to eliminate this barrier of entry from its use. Furthermore, it is an object of this invention that the device be such that it is easy to install and use. It is another object of this invention that the device be effective in preventing theft/vandalism of the unit.

These and other features, aspects and advantages of the present invention will become better understood with reference to the following description, appended claims and accompanying drawing.

DESCRIPTION

Figure 1:
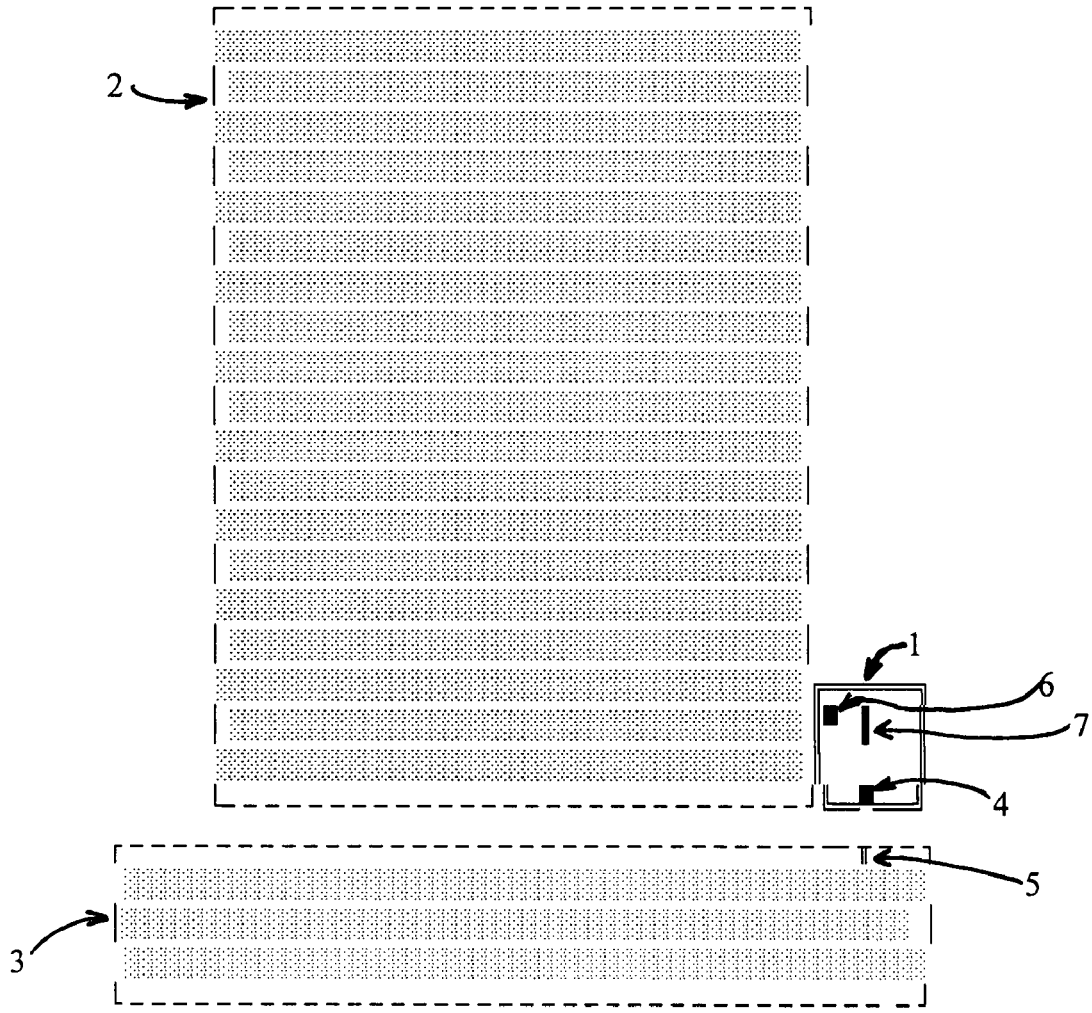
FIG. 1: shows a schematic of one claimed embodiment.

This air conditioner anti-theft device may be produced from an enclosed case, with an interior space, which is weather proof and tamper resistant, but can be opened with a special key or tool; to allow for service and/or maintenance. In one preferred embodiment, the case 1 is fixedly attached to the exterior, as shown in FIG. 1, of the air conditioner unit 2, which is then mounted or placed on a pad or slab 3. The unit could also be mounted inside the air conditioner unit, but this would eliminate any deterrent effect that visibly seeing the anti-theft unit might provide.

In this preferred embodiment, the case is mounted near the bottom of the air conditioner to allow for the use of a reed switch 4, as the means to detect an attempted theft and/or vandalism of the air conditioner. In this embodiment, one portion of the reed switch 4 is contained in the case 1 and the other portion of the reed switch 5 is placed into the pad or slab 3 on which the air conditioner unit is mounted. In other embodiments, this sensor could be a digital movement sensor or a sensor incorporating a bubble level or other sensors which detect movement or activity, which are commonly known in the art. There is then a means to communicate sensor detection in some manner. In the preferred embodiment, this means is a 120 db siren 7 that is enclosed in the case 1. Other means, or combinations, might include one or more of the following: a siren or horn or lights that are not mounted in the case 1, but rather another nearby location; a silent alarm that contacts a monitoring station alerting them to the situation; or a call to a preprogrammed telephone number.

In the preferred embodiment, power to the communication means and potentially, the sensor, is provided by a battery 6, contained within the case 1. Other means to provide this power could be an AC connection or even solar power. Lastly, while the preferred embodiment of the case is rectangular in shape, any shape, including square or circle, could be used for the case.

Although the present invention has been described in considerable detail with reference to certain preferred versions thereof, other versions are possible. Therefore, the spirit and scope of the appended claims should not be limited to the description of the preferred versions contained herein.

What is claimed is:

1. An air conditioner anti-theft device comprising:

a) a self-contained enclosed case having an open interior space, but which is weather and tamper resistant, to prevent disabling of the device prior to an attempted theft or vandalism;

b) a means to securely mount the case to an air conditioner unit, but not directly to the condenser coils, heat exchange fin(s), or any other element of the condenser coil unit;

c) a sensor contained in the case which detects an attempted theft or vandalism of the air conditioner unit;

d) a means to externally communicate sensor detection of a theft and/or vandalism condition to the air conditioner unit.

2. The device of claim 1 whereby the sensor is a reed switch with one part of the switch in the case and the other portion of the switch mounted to a location not on, or within, the air conditioner unit.

3. The device of claim 1 whereby the sensor is digital movement sensing device.

4. The device of claim 1 whereby the sensor incorporates a detection means involving a bubble level.

5. The device of claim 1 whereby the means to secure the case is on the exterior of the air conditioner unit.

6. The device of claim 1 whereby the means to secure the case is on the interior of the air conditioner unit.

7. The device of claim 1 whereby the communication means and/or the sensor is powered by a battery contained in the case.

8. The device of claim 1 whereby the communication means and/or the sensor is powered by AC power connected to the case.

9. The device of claim 1 whereby the communication means and/or the sensor is powered by solar power which is stored in and/or connected to the case.

10. The device of claim 1 whereby the means to communicate sensor detection is a siren or horn contained in the case.

11. The device of claim 10 whereby the means to communicate sensor detection is a 120 db siren contained in the case.

12. The device of claim 1 whereby the means to communicate sensor detection is a siren or horn that is not contained in the case.

13. The device of claim 1 whereby the means to communicate sensor detection is a silent alarm to a remote monitoring station.

14. The device of claim 1 whereby the means to communicate sensor detection is a call to a preprogrammed telephone number.

15. The device of claim 1 whereby the means to communicate sensor detection is one or more combinations of a siren or horn, whether contained in the case or not, a silent alarm, or a call to a preprogrammed telephone number.

* * * * *